US005402911A

United States Patent [19]

Noell

[11] Patent Number: 5,402,911

[45] Date of Patent: Apr. 4, 1995

[54] RECONFIGURABLE ARTICLE DISPENSER

[76] Inventor: Robert E. Noell, P.O. Box 727, Ozona, Fla. 34460

[21] Appl. No.: 231,167

[22] Filed: Apr. 22, 1994

[51] Int. Cl.[6] ..... G07F 11/24

[52] U.S. Cl. ..... 221/81; 221/82; 221/95; 221/107; 221/115; 221/120; 221/121; 221/131; 221/265

[58] Field of Search ..... 221/81, 82, 86, 94, 221/95, 103, 107, 111, 112, 115, 120, 121, 126, 127, 130, 131, 133, 125, 175, 176, 182, 263, 265, 277, 291, DIG. 1

[56] References Cited

U.S. PATENT DOCUMENTS

| | | | |
|---|---|---|---|
| 907,449 | 12/1908 | Bock | 221/277 X |
| 2,187,233 | 1/1940 | Garner et al. | 221/81 X |
| 2,429,745 | 10/1947 | Carlson | 221/277 X |
| 2,493,956 | 1/1950 | Ewertz | 221/81 |
| 2,684,143 | 7/1954 | Obodzinski . | |
| 2,918,197 | 12/1959 | Ritscher et al. | 221/277 X |
| 3,194,432 | 7/1965 | Breitenstein et al. . | |
| 4,511,058 | 4/1985 | Carminati | 221/2 |

OTHER PUBLICATIONS

Noel Industries, Inc brochure.

*Primary Examiner*—James R. Bidwell
*Assistant Examiner*—Dean A. Reichard
*Attorney, Agent, or Firm*—David Kiewit

[57] ABSTRACT

A multi-station article dispensing apparatus for use in a "merchandiser" game of skill or chance has a plurality of delivery/display stations juxtaposed along an axle. Each station includes a cradle wheel rotating freely about the axle and loaded from a gravity-fed magazine. Each cradle wheel includes a plurality of drive pins parallel to the axle. The cradle wheel is rotated by a drive rod that nutates along its axis to engage a drive pin. Each drive rod has a solenoid rotatably connected to it and engages its respective drive pin whenever that solenoid is actuated. When the solenoid associated with a given drive rod is not actuated, a bias spring moves the drive rod to a position in which it does not engage a drive pin. Thus, although a single motor and drive train drives all the drive rods in unison, only a selected cradle wheel is rotated. This arrangement of a single drive train and a plurality of cradle wheels of differing sizes juxtaposed along a shaft allows the apparatus to be easily reconfigured to handle a variety of product sizes and to incorporate various numbers of dispensing stations within a single apparatus.

12 Claims, 4 Drawing Sheets

RECONFIGURABLE ARTICLE DISPENSER

BACKGROUND OF THE INVENTION

Machines called "merchandisers" or "merchandise games" display multiple items that may be won by a person playing a game of skill or chance. There are several notable such games in the prior art:

Machines sold under the registered trademark "LAX" include a prize dispensing apparatus that responds to the deposit of money by loading prizes onto a rotating playing surface. The player uses an arm-like mechanism to attempt to sweep a selected prize into a delivery chute.

U.S. Pat. No. 4,133,525, by Balles et al., teaches apparatus for a game of skill in which an arm makes a single sweep across a rotary table loaded with prizes.

U.S. Pat. No. 4,726,585, by Shoemaker teaches an amusement apparatus comprising two conveyor belts moving in opposing directions and a prize-sweeping arm that moves transverse to the two belts. Shoemaker's game includes a reloading mechanism that adds a new prize to the playing surface each time a prize is swept into the delivery chute.

The prior art of electro-mechanical article dispensing is replete with designs minimizing the number of motors and electromechanical actuators required. This is done in the interest of reducing cost and of increasing reliability. Examples of such teaching is offered by:

U.S. Pat. No. 3,194,432, wherein Breitenstein et al disclose a vending machine with a plurality of vending stations (A multi-station article dispensing apparatus, hereinafter, is one in which each vending "station" offers a user a different choice, and comprises article storage and display apparatus. Other elements of the overall article dispensing apparatus, such as coin acceptance mechanism, a control means, an electromechanical actuator, a heating or cooling subsystem, etc., may be shared among a plurality of stations). Each of Breitenstein et al's stations is supplied by a single rotating magazine. Breitenstein et al's machine has a delivery mechanism using a single electric motor and a plurality of electro-mechanical actuators, one for each vending station.

U.S. Pat. No. 4,991,739, wherein Levasseur teaches a multi-station beverage can vending machine driven by a single selectively reversible motor. Levasseur provides multiple can magazines at each station (The magazines, or product stacks, are juxtaposed one behind the other). This design replaces complex mechanical and electro-mechanical mechanisms with a sophisticated electronic control system to track the position of a chain-driven trip element and to reverse the motor immediately after the trip element passes a selected station, thus causing the trip element to deliver the selected product.

It is common practice in the vending machine art to design a machine to operate only with products that fall into a narrow range of sizes, although some machines are adaptable to a wider range of product size than others. Levasseur's teaching in U.S. Pat. No. 4,991,739, for example, includes a dispensing mechanism operable only with cylindrical products of a standardized length and diameter—i.e., the conventional 12 oz. beverage can. Breitenstein et al's teaching in U.S. Pat. No. 3,194,432, on the other hand, provides a plurality of vending stations, each of which is operable for a small range of product sizes—e.g., candy bars. Rubbenark, in U.S. Pat. No. 4,869,395, discloses a vending machine that uses magazines of two widths and a single height. Rubbenark's narrower magazine is substantially one half the width of his wider magazine.

Other dispensing mechanisms that use pinned wheels or cradle wheels are known in the art and include:

U.S. Pat. No. 2,684,143, wherein Obodzinski discloses a manual coin acceptance mechanism in which two disks on a single horizontal axle are joined by a plurality of pins parallel to that axle. The pins define a plurality of pockets that accept coins, but that are not subject to jamming by foreign articles inserted into the coin slot. Obodzinski further discloses a product-dispensing cradle wheel that has a plurality of cylindrical article-receiving pockets parallel to the axis of rotation of the wheel and that is gravity fed from a hopper. The teaching of Obodzinski is herein incorporated by reference.

U.S. Pat. No. 3,785,509, wherein Girardi describes a gravity-fed cradle wheel with a bell-crank clamp that holds an item in a cradle until the wheel rotates 180° to deliver the item.

U.S. Pat. No. 4,511,058, wherein Carminati provides a grooved drum with a circumferential cover, or retainer, that feeds bicycle spokes into a guide device.

U.S. Pat. No. 5,228,168, wherein Hollrock et al teach the use of a pocketed wheel dispenser in which fillers are used to change the depth of pockets and thereby to vary the number of articles that fit within a pocket.

Merchandise games commonly offer a variety of prizes of differing perceived value and of differing sizes. The variation in prize value is inherent in the success of many such games. These games readily dispense low value prizes to induce a player, who is playing for a high value prize, to continue his play. Thus, it is desirable that an article dispenser used in a merchandise game incorporate a plurality of display and dispensing stations capable of dispensing prizes of a variety of sizes and shapes.

Players of coin-operated games demand variety and novelty. In many such games (e.g., the well-known pin-ball machine) the manufacturer is able to provide a high degree of player-perceived novelty by minor reconfigurations (e.g., changing the number and location of holes for the ball) and by alterations in the labelling and graphics associated with the game. In this case the manufacturer can realize substantial operating economies by using standardized parts and subassemblies for a wide variety of games. Thus, it is desirable that an article dispenser subsystem for a merchandise game be usable with a wide variety of such games so that a minimum cost and effort is needed to reconfigure the dispenser for each new game.

SUMMARY OF THE INVENTION

The invention provides a multi-station article dispensing apparatus comprising a plurality of juxtaposed delivery/display stations. In the preferred version of the apparatus, one or more gravity-fed magazines serve each of the delivery/display stations.

It is an object of the invention to provide an article dispenser usable with a variety of "merchandiser"

games, and that requires minimal reconfiguration to serve the specific needs of a given game.

It is a further object of the invention to provide an article dispenser usable in multi-station dispensing equipments having a varying number of stations.

It is yet a further object of the invention to provide a multi-station article dispenser that can be reconfigured to operate with a variety of station widths within a given enclosure.

DETAILED DESCRIPTION

Figure 1:
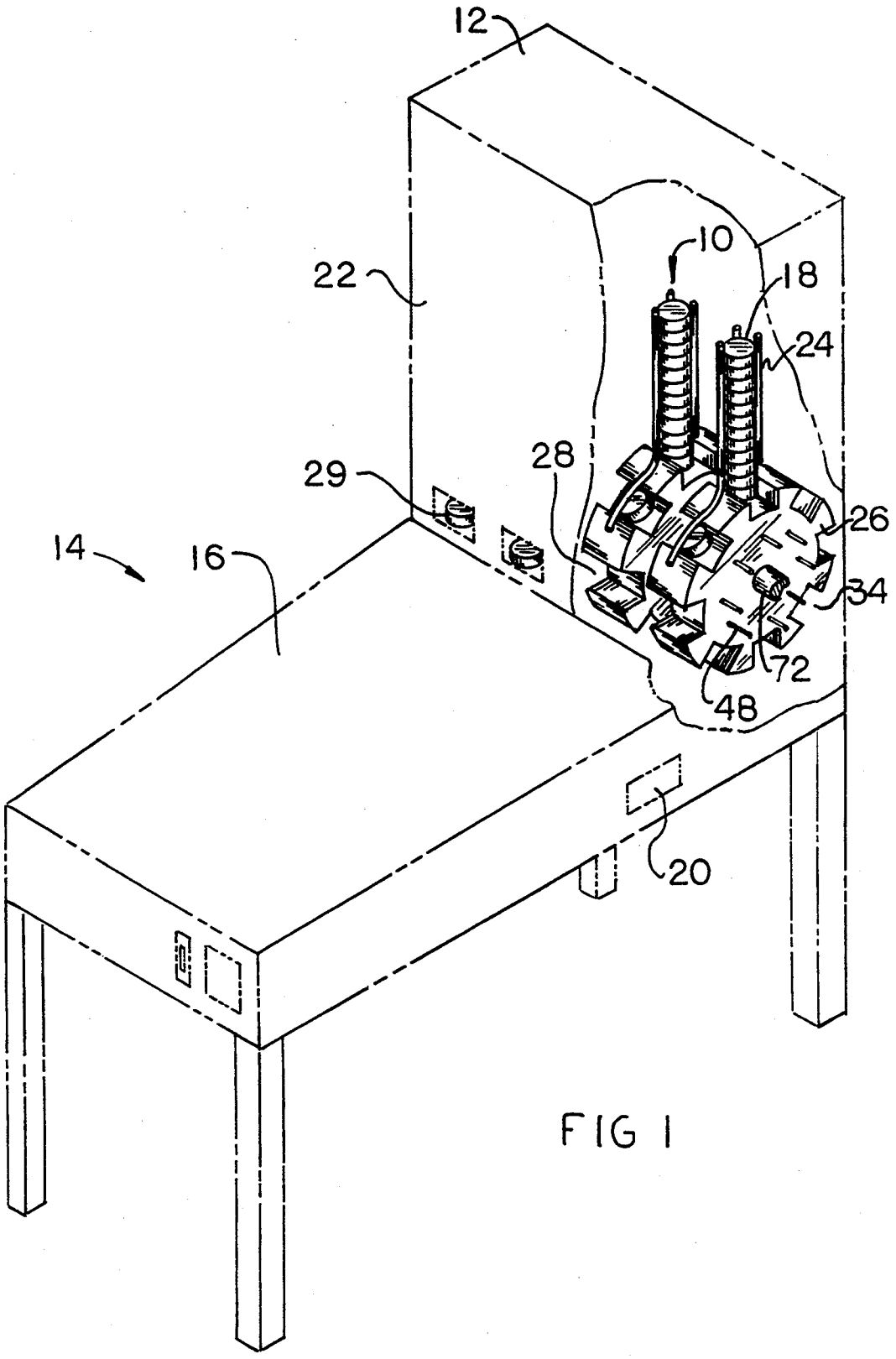
FIG. 1 of the drawing is a partly cut-away perspective view of a multi-station apparatus of the invention used with a game of skill or chance.

Turning initially to FIG. 1 of the drawing, one finds a pair of article dispensing stations 10 of the invention installed in the generally vertically oriented rear housing 12 of a game 14 that has a more or less horizontal playing surface 16. A variety of games of skill, chance, or a combination thereof may be used as the game 14, which forms no part of the invention and which is shown in phantom in the view of FIG. 1. A successful play, or some combination of successful plays of the game 14 results in the delivery of a prize or other dispensed article 18 either onto the playing surface 16 or directly into a chute or other delivery means 20.

Many amusement games, such as the well-known pinball game 14 illustrated in FIG. 1, are built with a generally vertical rear housing 12 that is wider than it is deep and that has a front surface 22 that can be used for graphics, for score displays etc. To accord with this customary game design, a preferred version of the article dispenser 10 uses a gravity fed stack or magazine 24 that delivers product 18 to an article-receiving cavity or cradle of a product carrier, which is preferably a cradle wheel 26. The operation of the dispenser 10, as will be subsequently discussed, rotates the top of the cradle wheel 26 forward into a position 28 in which the available prize 18 is displayed to the player (e.g., through a window 29 in the front wall 22). Subsequent rotation of the cradle wheel 26, which can be better seen in the view of FIG. 2, delivers the article 18 by dropping it from the wheel 26.

It is generally desirable to provide the player of a merchandise game with a selection of prizes 18 with a perceived range of values and a concomitant range of sizes. This is provided by juxtaposing a plurality of article dispensers 10 across the rear housing 12 of the game, and by using cradle wheels 26 of varying width (measured along their common axis of rotation) to accommodate prizes of varying size. The juxtaposition of multiple vending stations is illustrated in FIG. 1, and with greater detail, in FIG. 4 of the drawing.

It will be understood to those skilled in the art of making games of amusement that various known subsystems, e.g., coin acceptors, electronic control mechanisms to control the operation of various motors and actuators, and of mechanical product delivery chutes etc., can be used to control the operation of article dispensers 10.

Figure 2:
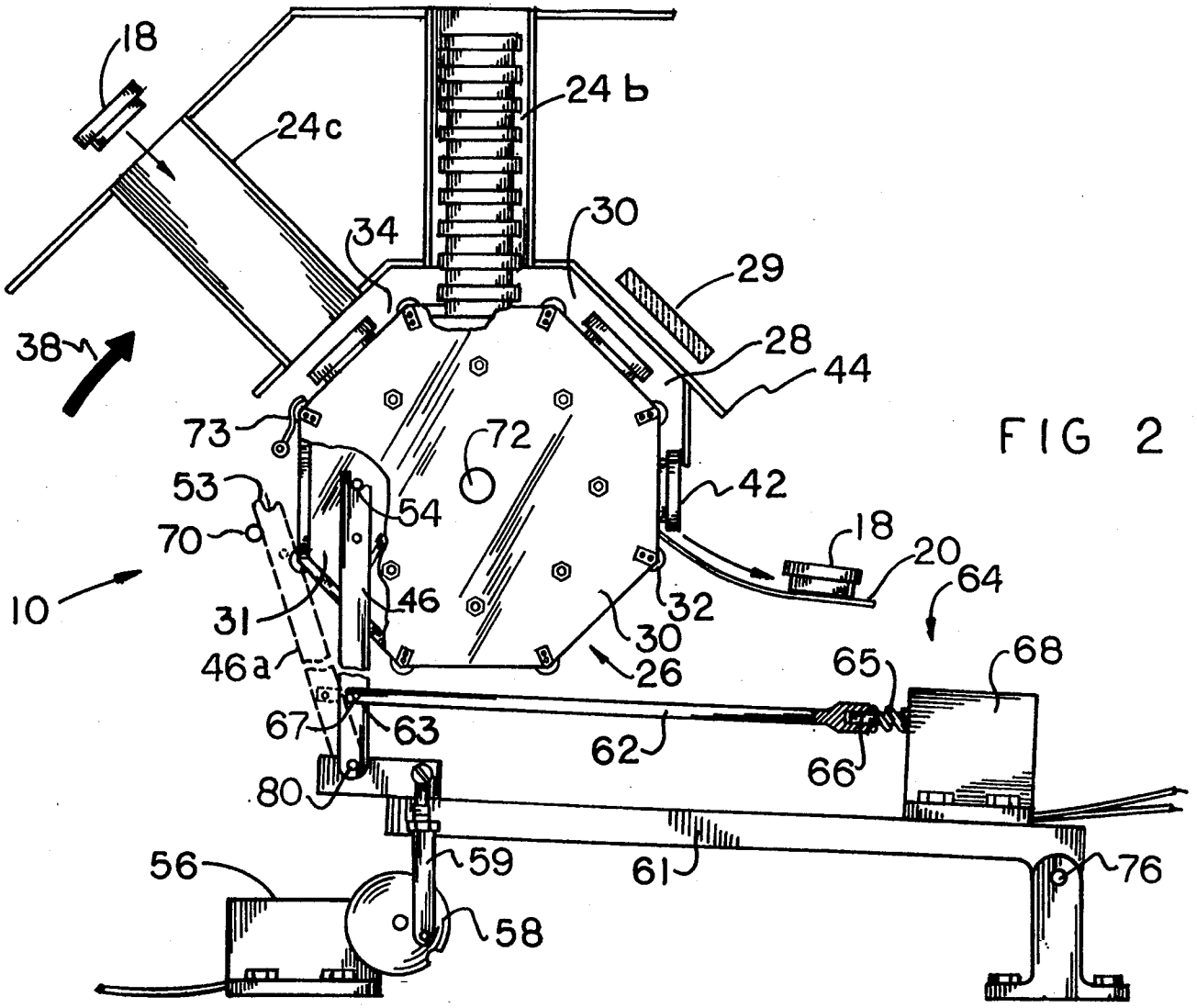
FIG. 2 of the drawing is a partly cut-away side view of a cradle-wheel delivery mechanism serving a delivery station.

Turning now to FIG. 2 of the drawing, one finds a partially cut-away view of a single article dispenser, or vending station 10 of the invention. It may be noted that although the cradle wheel 26 was shown in FIG. 1 as a solid body with drive pins 48 protruding from it, the embodiment shown in FIGS. 2, 3 and 4 has a cradle wheel 26 made of two polygonal disks 30, 31 with pins 48 extending between them.

A cradle 34 may be cut into a solid cradle wheel 26 (e.g., the wheel of FIG. 1). Alternately (e.g., FIG. 2), the base of the cradle 34 may be defined by the flat surfaces of a pair of polygonal disks 30, 31 that are spaced apart a distance chosen so packages of a predetermined size are supported on the disks 30, 31 and the product does not fall between them. In this latter case, the ends of the cradle may be defined by raised tabs 32 at the apices of the polygons that keep the product from falling off the cradle 34 until the cradle wheel 26 has rotated to an appropriate delivery position 42 at which point the prize 18 is delivered under the influence of gravity into a delivery chute 20. In yet another embodiment (e.g., FIG. 3), ledges 33 or tabs on the inner surface of the polygonal disks 30, 31 may be used to define a cradle 34.

Figure 3:
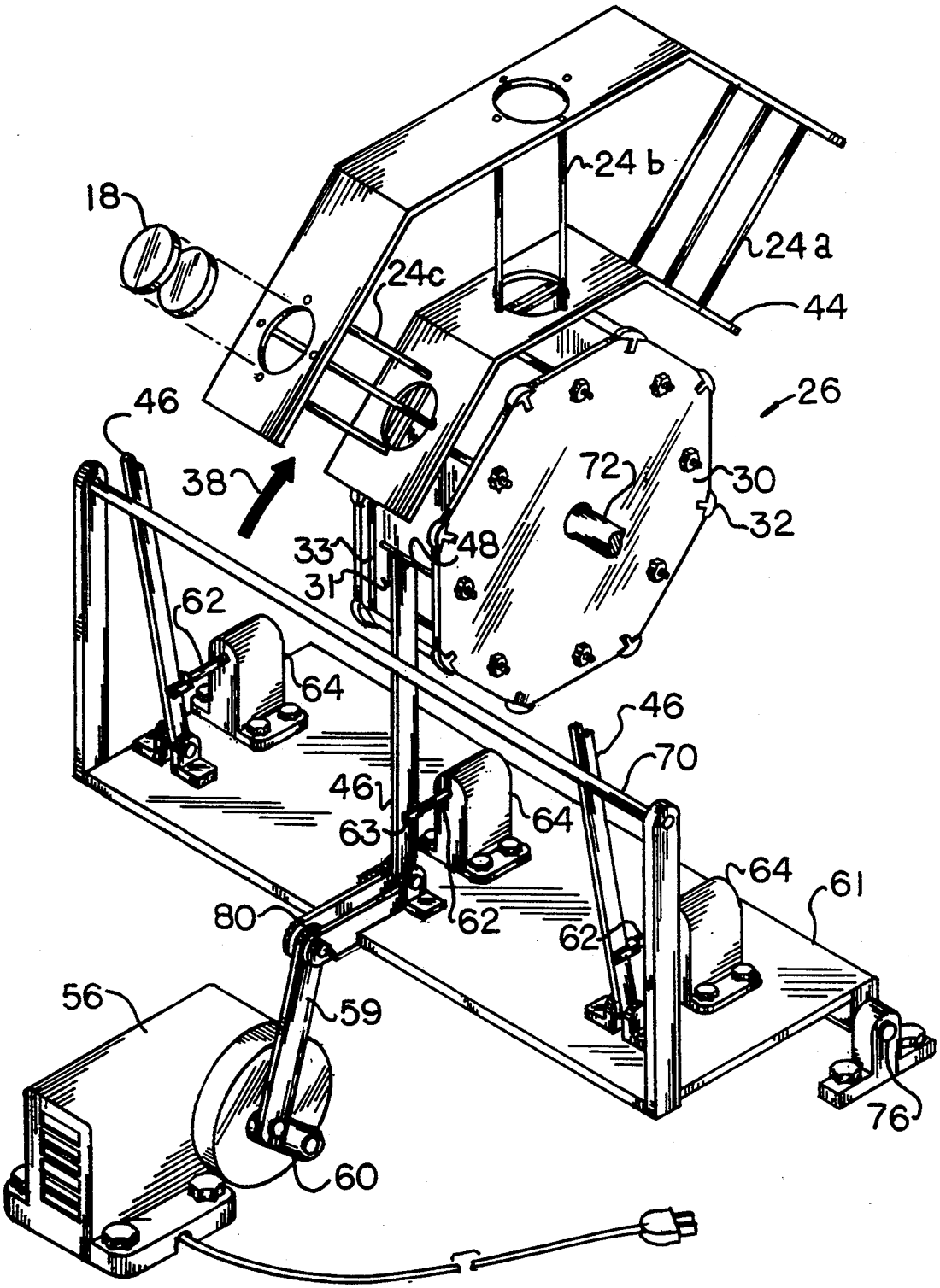
FIG. 3 of the drawing is a cut-away perspective view of a cradle wheel shown with driving and support elements used for a plurality of dispensing stations.

The packaged products 18 to be delivered are preferably stacked in one or more gravity-fed magazines **24*a*, 24*b*, 24*c* arrayed from front to back in the housing 12. As shown in FIGS. 2 and 3, the products may be packaged in a standard container (which may be a cardboard box or a transparent 'puck package', that generally looks like a petri-dish). Products feed from magazines 24*a*, 24*b*, 24*c* of FIG. 3 into cradles 34 as the wheel 26 rotates in the direction indicated by the arrow 38. As is seen in FIG. 2, the rotation of filled cradles 34 carries them into a delivery position 42, at which point the product 18 falls off the cradle wheel 26 into a chute 20 or other delivery means. Although the depiction of FIGS. 1–3 show a cradle wheel 26 with six cradles 34**, it will be understood that more or fewer cradles may be employed as a matter of design choice.

If three magazines **24*a*, 24*b*, 24*c* are used, as shown in FIG. 3, the rearward magazine 24*c* initially feeds product 18 into empty cradles 34 that then pass under the central 24*b* magazine and under the forward magazine 24*a*. After the supply of product 18 in the rearward magazine 24*c* is exhausted, deliveries are made from the central magazine 24*b* until it is exhausted, following which deliveries are made from the forward magazine 24*a*. A similar arrangement with two magazines 24*b* and 24*c* and a viewing window 29, is shown in FIG. 2. Because each wheel first displays and then delivers the product (e.g., FIG. 2), the player of the game 14 sees the actual product 18 to be delivered, although he or she need not be aware of the number and arrangement of magazines 24** involved in the delivery of the product.

It will be clear to those skilled in the art that a cradle wheel apparatus similar to that shown in FIG. 1 of the drawing could be configured to use a spring-loaded magazine to place products 18 into cradles 34 instead of relying on gravity feed. Since the magazines 24 are disposed along radii of the cradle wheel 26, the use of spring fed magazines could allow for additional generally horizontal or upward-feeding magazines (not shown). This would require additional circumferential retainers 44 to keep the product 18 from falling out of a vertical or downward facing cradle. The embodiment of FIGS. 2 and 3 of the drawing, on the other hand, has a drive rod 46 between the two polygonal wheels 30, 31 and therefore employs magazines 24 that are above the top of the stroke of the driving end 54 of the rod 46.

Circumferential sheet retainers or guard wires 44 are preferably disposed adjacent selected portions of the periphery of the cradle wheel. This is indicated in FIG. 2 as being at least over the portion of the cradle wheel that extends from the forwardmost magazine 24*b* to beyond the display position 28. These retainers, as is well known in the art, can prevent a thief from tilting the game 14 and shaking products 18 into the chute 20.

Figure 4:
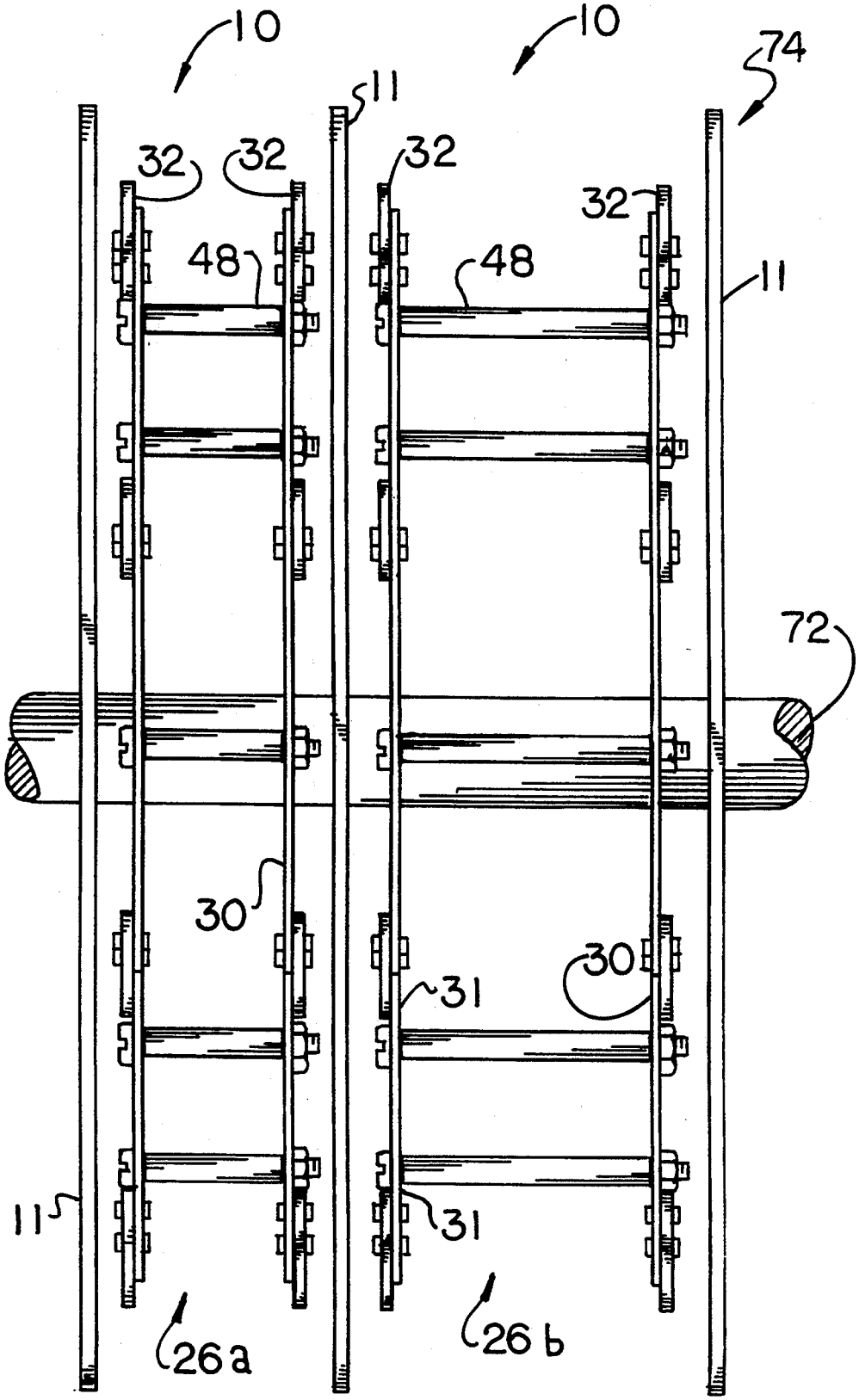
FIG. 4 of the drawing is a front view showing two dispensing stations of different widths juxtaposed on an axle.

In the embodiment shown in FIG. 2, the cradle wheel 26 is rotated stepwise by a driving element, which is preferably a drive rod 46. The drive rod 46 engages a pin 48 that is parallel to the rotational axis of the wheel 26—i.e., parallel to the axle 72. The pin 48 may be a stud projecting outward from an exterior surface of the cradle wheel 26 (e.g., as shown in FIG. 1) or may be a pin that extends between two disks 30, 31 that define the cradle wheel 26, as shown in FIGS. 2–4. The generally sigmoidal profile of the driving end 54 of the drive rod 46 is selected so that a rotational drive event ends when the pin or stud 48 slips out of engagement with the drive rod 46, e.g., by sliding over the cusp 53. Since the drive rod 46 nutates axially along a chord of the cradle wheel 26, rather than along the arc that the stud 48 follows, it is clear that slip or other means of accommodating this geometrical mismatch is necessary.

Article delivery mechanisms of the invention that have been made to date have used one drive pin 48 per cradle 34. However, one may also consider similar delivery mechanisms using a plurality of drive pins or studs per cradle. In this case multiple strokes of the drive rod 46 would be used to make each delivery. Such a delivery mechanism could be used, for example, in a game in which the player had to score a number of points (each of which could advance the delivery mechanism perceptibly) before he or she accumulated a high enough score to move the product carrier 26 far enough to make a delivery.

The elongate drive rod 46 is stroked or translated along its longitudinal axis by an electric motor 56 that may drive a cam wheel 58 and a crank arm 59 (e.g., FIG. 2) or arms 59, 60 (e.g., FIG. 3) that are coupled via a treadle or camming unit 61 to the drive rod 46, the bottom end of which is pivotally joined to the treadle 61. As is well known in the art, the motor 56 may be turned on by a suitable control means (not shown) and turned off after one revolution (which corresponds to one stroke of the drive rod 46). This is commonly done by means of a switch (not shown) actuated by the cam wheel 58. The drive rod 46 is moved between a resting, or non-selected, position (indicated in phantom as 46*a* in FIG. 2) and a driving position by an electro-mechanical actuator 64. In the preferred embodiment the drive rod 46 is attached to the actuator with a pin or other rotatable joint 63. The actuator 64 is preferably a pull-type solenoid with a normally extended plunger 66. The plunger 66 may be connected to that end of an extension arm 62 that is proximal the solenoid. The distal end 67 of the arm 62 is attached to the drive rod 46. In the drive rod's non-selected position (i.e., when the associated solenoid 64 is not energized) the force of a bias spring 65 pushes the arm 62 away from the solenoid 64 and holds the drive rod 46*a* against a stop 70, which may be a dowel or other rod 70 parallel to the cradle wheel axle 72. When a non-selected drive rod 46*a* strokes, it slides over the stop dowel 70 without engaging the drive stud 48 on the cradle wheel 26. In its selected position (i.e., when the associated solenoid 64 is energized) the drive rod 46 is pulled off the stop 70 by the solenoid 64 to engage a drive stud 48 and to rotate the cradle wheel 26 one step as the motor 56 traverses a single revolution.

Other known approaches to moving the drive element back and forth along its axis could also be used in the apparatus of the invention. For example, the electric motor 56 could be used to rotate a splined drive shaft (not shown) that engaged a rack of gear teeth formed on one side of a drive rod to propel the rod upwards. At the end of a prescribed travel, the direction of rotation of the motor in this embodiment would be reversed and the motor run until the drive rod was returned to its original starting position.

Although the preferred embodiment of the invention employs a rotatable joint 63 to attach the arm 62 and actuator 64 to the drive rod 46, other attachment methods compatible with the mechanical requirement that the drive element 46 be translated along its axis in either a stud-engaging or a non-stud-engaging stroke could be used. For example, one could form a loop at the distal end of the arm 62 (e.g. by welding a ring to the end of the arm 62) and then allow the drive rod 46 to slide back and forth through the loop.

It may be noted that in the embodiment of FIG. 2, the cradle wheel 26 rotates relatively freely about the stationary axle 72. An apparent shortcoming of this design is that if one were to load a massive product 18 from an otherwise empty magazine 24 into a cradle 34 of a relatively light wheel 26 that rotated in a completely friction-free fashion about an axle 72, and then step the cradle wheel 26 so that the massive product 18 was driven to the display position 28, gravity and inertia would both act to keep the wheel 26 rotating until the product 18 was dumped into the chute 20. This undesirable situation is easily avoided by a combination of design choice, operational discipline, and frictional forces. The prizes 18 that are usually used in a merchandiser are commonly relatively light in weight, while the cradle wheel 26 is more massive (adding weight to the cradle wheel 26 offers an additional benefit of making it more difficult for a thief to tilt the merchandiser 14 in an effort to shake down prizes 18). Thus, the gravitational forces acting on the out-of-balance wheel 26 that had a single product 18 at the display position 28 may be inconsequential. Moreover, as long as the magazines 24 are kept full of prizes 18, the frictional drag between a product 18 in a cradle 34 that is under a magazine 24 and the product 18 immediately above it also acts to prevent freewheeling of the cradle wheel 26. Frictional forces between the wheel 26 and the axle 72 also aid to prevent freewheeling. Frictional drag can also be provided by a finger 73 or the like dragging on the periphery of the wheel 26 or on the axle 72.

The extendibility of the preferred driving mechanism to provide an article dispensing apparatus 74 comprising multiple dispensing stations 10 within a housing of a single game 14 is made apparent in FIGS. 3 and 4 of the drawing. FIG. 4 shows a pair of cradle wheels 26 juxtaposed along a single cradle wheel axle 72. (The magazines, drive rods, dowel, and various other elements have been deleted from FIG. 4 in the interest of a simpler presentation). This arrangement provides a plurality of dispensing stations 10, each of which has its own electro-mechanical actuator 64 and all of which share a single electric motor 56 and a single treadle 61 oscillating about a hinge shaft 76 to stroke all the drive rods 46 in unison. Although all the drive rods 46 stroke whenever the camming unit 61 moves through a single oscillation, only selected ones of the rods 46 are pulled into a driving position by their associated solenoids 64. It is expected that in most uses of the apparatus, only a single cradle wheel 26 will be stepped during a rotation of the motor 56.

The multi-station configuration shown in FIGS. 3 and 4 provides a simple way of juxtaposing vending stations by sliding various elements of each station onto the axle 72 and onto shafts parallel to it. The hinged end of a single treadle 61 oscillates about a hinge shaft 76. A rotatable joint 80 attaches a crank arm 59 to the driven end of the treadle 61 so that the rotation of the motor 56 oscillates the treadle along an arc about the hinge rod 76 and thereby translates each drive rod 46 along the axis thereof. The magazines 24 may also be slideably positioned along a shaft or rail parallel to the axle 72.

Although FIGS. 3 and 4 show a single treadle 61, it will be understood by those skilled in the art that one could as well use a plurality of narrower camming units (e.g., one treadle per vending station) with each treadle rotatably joined to the hinge shaft 76 at one end and to the crank arm 59 at the other. These treadles could be secured at appropriate positions along the hinge shaft 76 by collars or other known retaining means.

Thus, all the elements of a single vending station 10 may be aligned at more or less arbitrarily chosen positions along the axle. This allows the manufacturer to accommodate a variety of mixes of product size and station number with a limited number of parts, as is demanded by a market that values variety and requires the manufacturer to deal with small unit orders for a wide number of merchandise-dispensing games with varying numbers and sizes of product delivery stations.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

1. Multi-station article dispensing apparatus comprising a horizontal axle, an electric motor moving each of a plurality of elongate drive elements along the longitudinal axis thereof, a plurality of vending stations, each said station comprising a product carrier rotating on said axle, a said elongate drive element, and an electromechanical actuator having an energized state and a non-energized state, said actuator coupling said drive element to said product carrier when said actuator is in said energized state, said actuator not coupling said drive element to said product carrier when said actuator is in said non-energized state, and a delivery means receiving products that fall from a said product carrier under the influence of gravity.

2. Multi-station article dispensing apparatus of claim 1 wherein each said actuator comprises a solenoid having a plunger rotatably attached to said drive element, said solenoid fixedly mounted to a treadle having two ends, a first end of said treadle rotatably attached to a hinge shaft parallel to said axle, said second end of said treadle oscillated about said hinge shaft by said motor.

3. Multi-station article dispensing apparatus of claim 1 wherein each said product carrier comprises a cradle wheel having a plurality of article-receiving cradles on the periphery thereof, and a gravity-fed magazine.

4. Apparatus of claim 3 further comprising a circumferential retainer adjacent a said cradle wheel.

5. Multi-station article dispensing apparatus of claim 1 wherein said product carrier comprises a cradle wheel having a drive pin associated with each cradle thereof, said drive pin parallel to said axle, said electromechanical actuator comprises a solenoid acting against the force of a bias spring to pull a plunger into the body of said solenoid when said solenoid is in said energized state, and said drive element comprises a drive rod rotatably attached to said plunger, an end of said drive rod engaging a said drive pin when said solenoid is in said energized state.

6. Apparatus of claim 5 wherein said end of said drive rod has a sigmoidal profile.

7. Article dispensing apparatus comprising a cradle wheel rotatable about an axle, said cradle wheel comprising a plurality of article-receiving cradles, said cradle wheel further comprising a plurality of drive pins parallel to said axle, each said cradle having a said drive pin associated therewith, a magazine adjacent said cradle wheel, said magazine supplying said article to a said article-receiving cradle, an electromechanical actuator having an actuated state and a non-actuated state, and a drive rod having an axis, said drive rod having a first end adjacent a said drive pin and a second end operatively connected to drive means translating said drive rod along said axis, said drive rod operatively connected to a plunger of said electromechanical actuator whereby said first end of said drive rod engages a said drive pin and rotates said cradle wheel when said drive means translates said drive rod and said actuator is in said actuated state, and whereby said first end of said drive rod does not engage a said drive pin when said actuator is in said non-actuated state.

8. Apparatus of claim 7 wherein said first end of said drive rod has a sigmoidal profile.

9. Apparatus of claim 7 wherein said drive means comprises an electric motor driving a crank arm, said crank arm rotatably attached to a camming unit, said camming unit pivotally connected to said drive rod, said crank arm oscillating said camming unit about a hinge shaft.

10. Apparatus of claim 7 wherein said actuator is a solenoid acting against the force of a bias spring to hold a plunger in a first position when said solenoid is in said actuated state, said plunger held in a second position by said bias spring when said solenoid is in said non-actuated state.

11. Apparatus of claim 7 wherein said axle is a horizontal axle and said magazine is gravity fed.

12. Apparatus of claim 11 further comprising a second said magazine.

* * * * *